United States Patent [19]

Makarkin et al.

[11] 4,145,906

[45] Mar. 27, 1979

[54] FEEDING DEVICE OF A TUBE COLD-ROLLING MILL

[75] Inventors: Nikolai S. Makarkin, Elektrostal Moskovskoi oblasti; Evgeny P. Solodikhin, Noginsk Moskovskoi oblasti; Vladimir V. Pljusnin, Dnepropetrovsk, all of U.S.S.R.

[73] Assignee: Proizvodstvennoe Obiedinenie "Elektrostaltyazhmash", U.S.S.R.

[21] Appl. No.: 879,628

[22] Filed: Feb. 21, 1978

[51] Int. Cl.[2] ..... B21B 39/06; B21B 21/04

[52] U.S. Cl. ..... 72/250; 72/208

[58] Field of Search ..... 72/250, 252, 208, 209, 72/214

[56] References Cited

U.S. PATENT DOCUMENTS

| | | | |
|---|---|---|---|
| 2,090,535 | 8/1937 | Knoll | 72/252 X |
| 2,783,666 | 3/1957 | McLoy | 72/252 X |

*Primary Examiner*—Milton S. Mehr

*Attorney, Agent, or Firm*—Steinberg & Blake

[57] ABSTRACT

The present invention relates to mills for cold rolling of tubes, and more particularly to the improvement of a feeding device incorporated in a tube cold-rolling mill. The feeding device in question comprises a means for pushing the tube to be rolled, a driven continuously moving link arrangement connected with the tube pushing device through a device for transmitting continuous motion of said link arrangement into intermittent motion of the pusher means along the axis of rolling. The transmission device comprises a body, a sleeve slidable in the travelling direction of the pusher device by means of the link arrangement, and two coaxially arranged resilient members with different degrees of rigidity, one of said resilient members being preloaded.

The resilient members each having its one end connected to the sleeve, and the other end to the pusher means, the other resilient member being connected to the body. The feeding device is thus rendered simple in construction, substantially smaller in weight, thereby contributing greatly to higher production efficiency of the tube cold-rolling mill.

6 Claims, 5 Drawing Figures

FEEDING DEVICE OF A TUBE COLD-ROLLING MILL

FIELD OF THE INVENTION

The present invention relates to mills for cold rolling of tubes, and more particularly, to a feeding device incorporated in such mills.

Present industrial conditions demand a tube rolling mill permitting high rates of rolling by displacing the rolled product in short spaces of time. Much, therefore, depends upon the feeding device which is subjected to high operating speeds and its elements, to high dynamic loads. It is therefore necessary to simplify structural or gearing arrangement of this device, to reduce the weight of its parts and preclude failures in the interaction of its parts.

Moreover, production efficiency of a tube-rolling mill depends upon the rate of feeding, and the quality of tubes, upon its stability. It is advisable therefore to provide the feeding device with replacable parts to thereby permit the feeding device to be set to a given feeding rate, and its construction ensuring feeding accuracy within a predetermined range.

It is known for a feeding device to include a means for pushing a tube to be rolled, a driven continuously moving link arrangement which is connected with the tube pushing means through a means adapted to transform continuous motion of the link arrangement to intermittent motion of the pusher means along the axis of rolling.

The transmission means mentioned above is usually mounted in a body and is made in the form of a detour shaft fitted with a cam and a clutch (cf. U.S.S.R. Inventor's Certificate No. 124,400). However, these devices are of complex construction, have an excessive number of gear and cam transmissions, as well as substantial flywheel masses, reducing service life of the feeding device as a whole.

There is also known a feeding device disclosed in British Pat. No. 1,293,399, which includes a rotatable jaw for gripping a product to be rolled and a lead screw arrangement mounting a carriage. Mounted on the carriage is a device for transforming continuous rotation of said lead screw into intermittent rotation of said jaw, comprising an oscillating means, a cam and a slidable sleeve which interacts with said jaw. The oscillating means is made in the form of a rocker arm periodically displaced by the cam mounted on the carriage and having its one arm interacted with the sleeve, its second arm interacting through a roller with the rotating sleeve, said cam being driven by the roller cage driving means. However, the transmitting device is not reliable enough, since the slightest difference in the speeds of rotation of the cam and the lead screw will cause a gap to occur between the cam and the rocker arm, leading to undesirable pulsating interaction therebetween. Alternatively, the rocker arm is subjected to axial stress from the tube being rolled, which, in turn, causes overload and break-down of the oscillating means and cam assembly, or else jamming of tubes being rolled.

The structural arrangement of the transforming device as described above renders the feeding device more complicated both in construction and operation. In addition, a change in the rate of reciprocation of the carriage along with the change in the speed of rotation of the lead screw will necessitate the replacement of the cam.

It is therefore an object of the present invention to obviate the above disadvantages.

The primary object of the invention is to provide a feeding device which is simple in construction.

Another object of the invention is to provide a feeding device of a tube cold-rolling mill, wherein a device for transforming continuous rotation into intermittent rotation will be designed so as to permit improved operating reliability of the feeding device as a whole.

These and other objects and features of the invention are attained in a feeding device of a tube cold-rolling mill, comprising a means for pushing a tube to be rolled, a driven continuously moving link arrangement connected to said tube pushing means through a means mounted in a body and adapted to transform continuous motion of said link arrangement into intermittent motion of the tube pushing means along the axis of rolling, wherein, according to the invention, the transmission means comprises a sleeve driven in the travelling direction of the tube pusher means from the continuously moving link arrangement, and two coaxially arranged resilient members having different degrees of rigidity, with at least one resilient member being preloaded, said resilient members each having its one end connected to the sleeve to thereby enable successive compression of said members caused by the movement of the sleeve, while opposite ends of each of said resilient members are respectively connected to the pusher means and to the body.

Therefore, the simple construction of the transmission means comprising a sleeve and two resilient members determines constructional simplicity of the feeding device as a whole, permitting the latter to be substantially reduced in weight.

The simplicity of construction of the feeding device enables its operating reliability and prolonged service which is due to a limited number of link members participating in intermittent movement, the weight of said members being insignificant to make it sluggish in operation. Thus, the rate of operation of the feeding device is increased due to fast response of the transmission means.

It is advisable that the resilient member connected with the sleeve and body should have a higher degree of rigidity than the resilient member connected with the sleeve and the pusher means, the resilient member with higher degree of rigidity being preloaded to a force exceeding the maximum compression force of the resilient member having lower degree of compression. High rate of operation is thus ensured due to undelayed and faultless operation of removing the rolled tube off the mandrel.

In accordance with the invention the sleeve displacement is effected by means of the driven link arrangement through the body which is secured on the latter and connected to said sleeve with the aid of preloaded resilient member. The sleeve is preferably mounted in the opening of the body and is formed with an adjustable stop adapted to restrict displacement of the sleeve relative to the body and regulate a magnitude of precompressed force of the resilient member, the pusher means being formed with a shank extending through the sleeve and having its free end projected beyond the sleeve and whereupon is adjustably mounted a stop adapted to restrict the movement of the sleeve relative to the pusher means.

In accordance with another embodiment of the transmission means the body and pusher means are formed with flanges, the flanges of the body and of the sleeve as well as those of the sleeve and the pusher means being connected in pairs by tie rods whereupon are adjustably mounted stops adapted to restrict the movement of the sleeve relative to the pusher means.

Such embodiments of the transmission device enables the rate of feeding of tubes to be regulated within a wide range, as well as the force required for removing a tube off the mandrel, depending upon the type of tubes being rolled.

The invention is further characterized by that the displacement of the sleeve driven from the link arrangement is effected through the intermediary of a slide positioned within a body fixedly mounted on the link arrangement being a screw of a worm pair, connected to an electric motor and mounted for reciprocation, the sleeve being mounted within the stationary body coaxially with the screw of the worm pair and in space relationship with the slide. The sleeve is also formed with an adjustably mounted stop adapted to restrict the movement of the slide relative to the sleeve, the resilient member cooperating with the pusher means through the intermediary of the slide, with said resilient member thrusting up thereagainst, as well as through the worm pair and rack transmission arrangement, on the rack of which is rigidly secured the pusher means.

Such constructional arrangement of the transmission device makes it possible to reduce the feeding device in length since its most elongated portion is offset with respect to the longitudinal axis of the rolling mill.

Therefore, due to the fact that the feeding device of the invention is free from conventional transmission units, such as, for example, a means for transforming continuous rotation of a drive into intermittent motion of the tube pushing means, the feeding device as a whole is rendered more simple in construction, its operating reliability is improved, repair and maintenance cost is cut down and its weight is reduced.

Moreover, owing to small weight and a limited number of parts comprising the feeding device of the invention and involved in intermittent motion, the rate of operation of said device is increased, thus rendering it applicable for adaptation on high-speed mills for cold rolling of tubes.

BRIEF DESCRIPTION OF THE DRAWINGS

The invention will be further described, by way of example only, with reference to the accompanying drawings, wherein.

DETAILED DESCRIPTION OF THE PREFERRED EMBODIMENT

Figure 1:
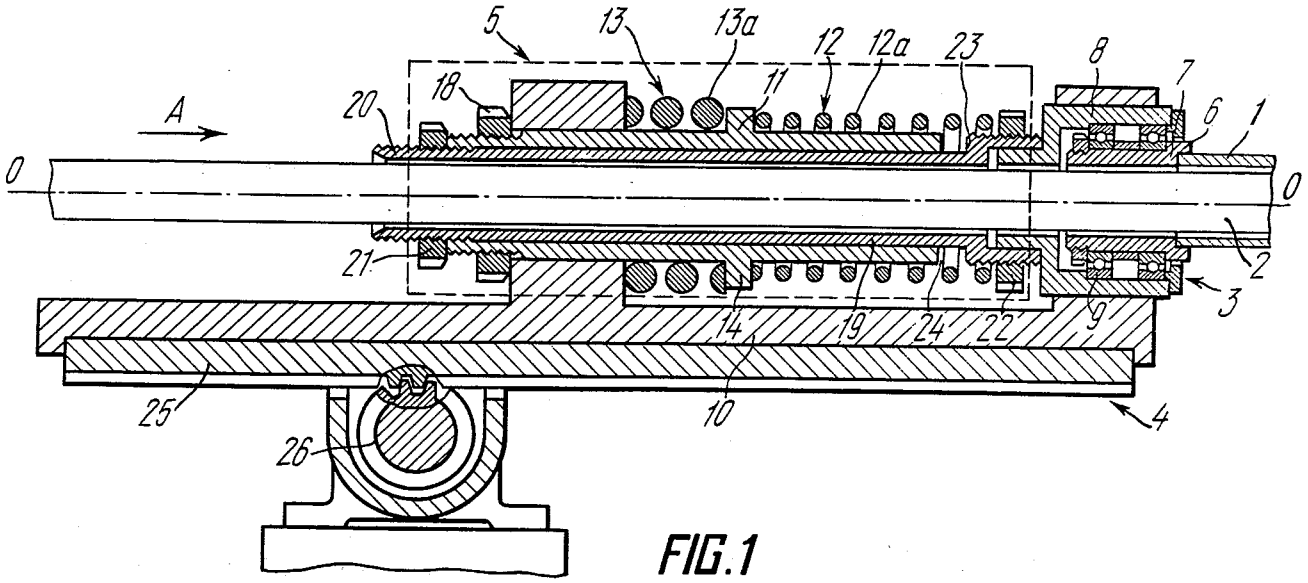
FIG. 1 is a schematic longitudinal view of a feeding device according to the invention.

In the preferred embodiment, a feeding device of a tube cold-rolling mill (FIGS. 1, 2 and 3) is mounted at the side of entrance of a tube 1 to be rolled on a mandrel 2 to a working stand of a rolling mill and comprises a means 3 for pushing the tube 1, arranged coaxially with the rolling axis 0—0 of the rolling mill, a driven continuously moving link arrangement 4 associated with the pusher 3 through a device 5 for transforming continuous motion of the link arrangement 4 into intermittent motion of the pusher means 3 along the axis of rolling.

The pusher 3 is formed of a cylinder 6 having one of its butt ends fitted with an annular recess to form a projection 7 for the end face of the tube 1 to bear up thereagainst, with a stepped sleeve 8 receiving in its expanded portion the cylinder 6 associating with the sleeve 8 through bearings 9 to provide for simultaneous rotation of the cylinder 6 with the tube 1. The diameters of the openings in the narrow portions of the sleeve 8 and cylinder 6 are selected so as to permit free passage of the mandrel 2 therethrough.

Figure 2:
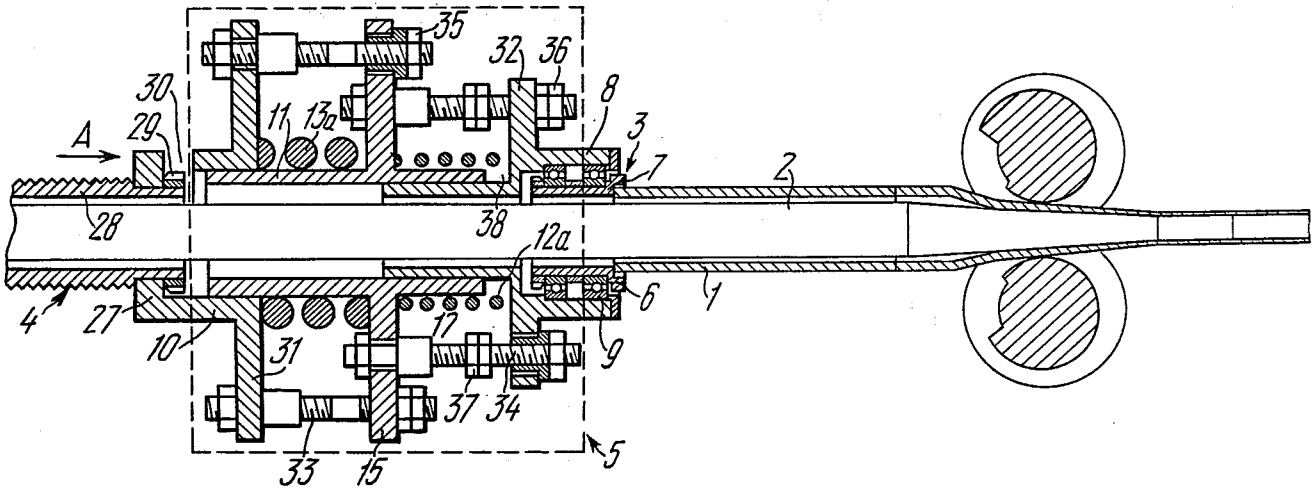
FIG. 2 is a schematic view of another embodiment of the invention.
Figure 3:
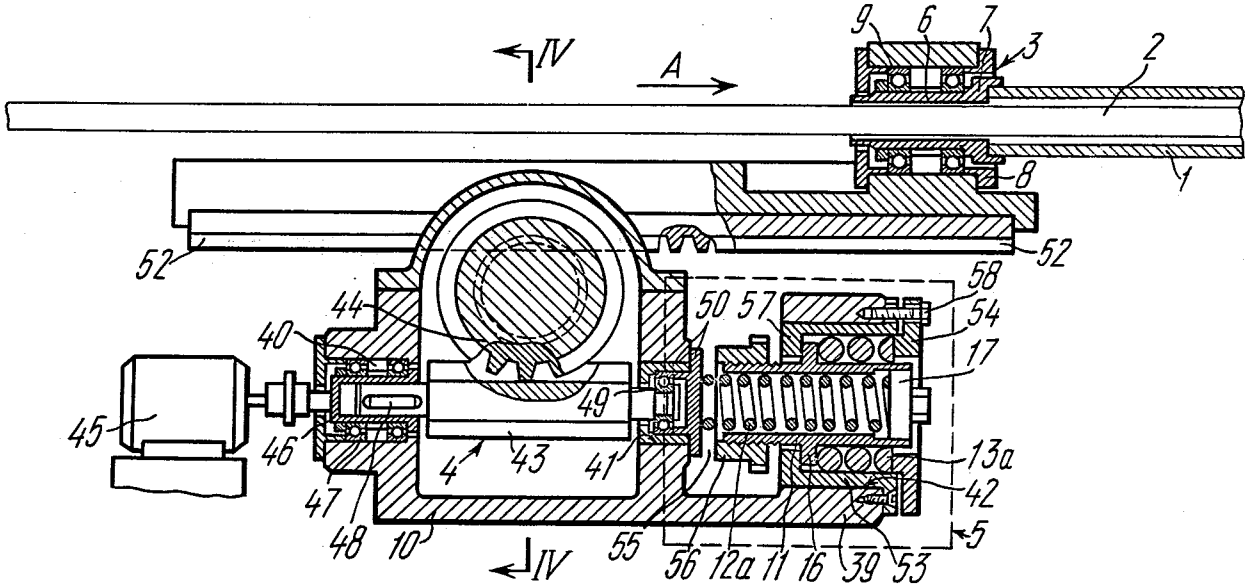
FIG. 3 is a schematic view of a feeding device wherein a drive and a transmission means are offset with respect to the rolling axis of a rolling mill.

In accordance with FIGS. 1, 2 and 3, the transmission means 5 comprises a body 10, a sleeve 8 slidable in the travelling direction of the pusher means 3 by means of the link arrangement 4, and two coaxially arranged resilient members 12 and 13 of different rigidity. Any conventional means, such as springs shown at **12*a* and 13*a* in FIGS. 1–3, can be used as such resilient members. The spring 13*a* has a higher degree of rigidity than the spring 12*a*, which is made possible, as shown in FIGS. 1–3**, due to different diameters of wire of said springs. This is also possible to accomplish by any other conventional means known to those skilled in the art and depends upon specific operating conditions of a rolling mill and the type of tubes being rolled.

Each of the springs **12*a* and 13*a* has one of its ends connected to the sleeve 11 through a projection, such as shown at 14 in FIG. 1, through a flange 15, such as shown in FIG. 2, and through a projection 16 and a stop 17, such as shown in FIG. 3, to thereby provide for successive compression of the springs 12*a* and 13*a* during movement of the sleeve 11. This successive compression of the springs 12*a* and 13*a* is made possible due to the fact that the spring 13*a* is preloaded. Therefore, it is natural that the movement of the sleeve 11 causes the spring 12*a* to compress first and then the spring 13*a***.

The opposite end of the spring **12*a* (FIGS. 1–3) is connected to the pusher means 3, and the spring 13*a*, having a higher degree of rigidity, is connected through its other end to the body 10. The spring 13*a* is preloaded to a force exceeding the maximum compression force of the spring 12*a* accommodated intermediate the pusher means 3 and the sleeve 11. Due to the fact that the spring 13*a* is placed intermediate the body 10 and the projection 14 of the sleeve 11 (FIG. 1) or between the former and the flange 15 of the sleeve (FIG. 2), their space relationship enables compression of this spring to a preset value. The spring 12*a*, however, can also be preloaded to reduce the rate of travel of the feeding device as a whole, though its compression force should be substantially lower than that of the spring 13*a***.

In accordance with the FIGS. 1 and 2, the movement of the sleeve 11 is effected with the aid of the link arrangement 4 through the body 10 which is secured on said link arrangement and is connected to the sleeve 11 through the spring **13*a*. The body 10 is formed with two coaxially arranged openings, such as shown in FIG. 1, of which one opening is adapted to receive the sleeve 11 of the transmission means, and the second opening, the sleeve 8 of the pusher means 3**.

The sleeve 11 extends beyond the body 10 away from the pusher means 3. This projecting end of the sleeve 11 is formed with a stop 18 which is mounted adjustably to thereby restrict the movement of the sleeve 11 relative to the body 10 and regulate a preloading force of the spring 13*a*. The stop 18 bears up against the body 10 and is formed as a screw nut screwed on the threaded projecting end of the sleeve 11.

The sleeve 8 of the pusher means 3 is formed with a shank 19 accommodated in the sleeve 11 and passes therethrough so that its free end 20 extends the sleeve 11 and is provided with a stop 21 adjustably mounted to thereby restrict the movement of the sleeve 11 relative to the pusher means 3. The stop 21 is formed as a screw nut screwed on the free end 20 of the shank 19, fitted with a thread and bearing up against the butt end of the sleeve 11. Mounted on the shank 19 of the sleeve 8 is a stop 22 also in the form of a screw nut. Thrusting up against this stop 22 is a spring 12*a*, the latter being in this way connected to the pusher means 3.

In addition, the shank 19 is formed with an indentation 23 for the butt end of the sleeve 11 to bear up thereagainst. At the initial moment of feeding the tube to be rolled, there is formed a gap 24 between the butt end of the sleeve 11 and the indentation 23 of the shank 19, which determines the feeding rate and compression degree of the spring 12*a* during the movement of the sleeve 11. This gap 24 is selected in the course of movement of the sleeve 11 and during compression of the spring 12*a*.

The driven continuously moving link arrangement 4 is basically a gear-and-rack mechanism, a rack 25 of which mounts the body 10, a gear wheel 26 thereof being set in rotation by any conventional means either from a main rolling mill drive or from an individual drive, not shown in FIG. 1.

In accordance with the FIG. 2, the body 10 of the transmission means 5 is formed as a sleeve with a shank 27 rigidly connected with the drive link arrangement 4 formed as a screw 28 coaxially mounted with the pusher 3 and made hollow to permit the mandrel 2 to pass therethrough.

The screw 28 is capable only of continuous advance motion transmitted thereto from a main rolling mill drive or an individual drive, with which it is connected by any conventional means.

Rigid connection between the shank 27 of the body 10 with the screw 28 is effected by means of a nut 29 screwed on the end of the screw 28 extended through the opening in the shank 27 of the body 10. To introduce the nut 29 into the body 10, the latter is formed with a slot 30.

With its narrow portion the sleeve 8 partially enters into the sleeve 11, such as shown in FIG. 2. The sleeve 11, body 10 and pusher means 3 (i.e. the pusher sleeve) are respectively provided with flanges 15, 31 and 32. The flanges 31 and 15 of the body 10 and the sleeve 11, as well as the flange 15 of the sleeve 11 and the flange 32 of the sleeve 8 are connected in pairs by means of threaded tie rods 33 and 34, respectively, the tie rods 33 and 34 being secured on one of the flanges and freely passing through the opening in another flange. To prevent said openings 33 and 34 from falling out of said tie rods, the former are fixed with the aid of nuts 35 and 36, respectively. By displacing the nuts 35 and 36 along the tie rods 33 and 34, the distance between the flanges 31, 15 and 32 is alternated, thereby enabling regulation of the preloading force of the springs 12*a* and 13*a*. The tie rods 34 mount stops 37 which are adjustable to restrict the movement of the sleeve 11 relative to the pusher means 3. The stops are formed as nuts screwed on the tie rods 34.

The spring 13*a* is arranged intermediate the flanges 31 and 15, whereas the spring 12*a* is arranged intermediate the flanges 15 and 32, the spring 12*a* thrusting up against the sleeve 8, thereby cooperating with the pusher means 3. There is provided between the butt end of the sleeve 11 and the flange 32 of the sleeve 8 a gap 38 which is adjusted in the course of movement of the sleeve 11 and compression of the spring 12*a*.

In accordance with the FIG. 3, the transmission means 5 comprises the body 10 which is mounted stationary and possesses an additional leg 39. The body 10 is also formed with three coaxially arranged openings 40, 41 and 42 and serves as a body of a worm pair, with a worm 43 thereof being actually the driven continuously moving link arrangement 4. The worm 43 is in uninterrupted engagement with a worm wheel 44 of said worm pair and is mounted for reciprocation.

The worm 43 is set in rotation by an electric motor 45 through the intermediary of a sleeve 46 mounted in bearings 47 in an opening 40 of the body 10, as well as through the intermediary of a key joint, the sleeve 46 being formed with an elongated key slot. Accommodated in the key slots of the sleeve 46 and of the worm 43 is a key 48.

The other end of the worm 43 is mounted in a bearing 49 in a slide 50 received in the opening 41 of the body 10. Due to projections provided on this end of the worm, the slide is displaced in the course of movement of the worm 43 together with the latter relative to the body 10.

Figure 4:
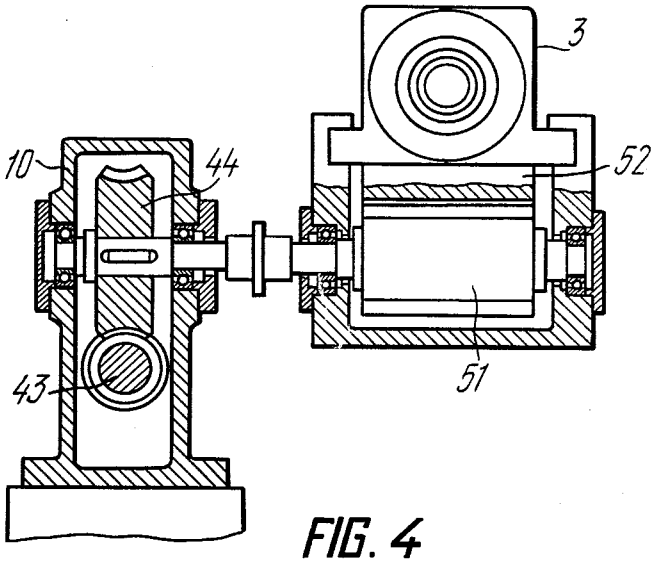
FIG. 4 is a cross-section IV—IV of FIG. 3.

Mounted coaxially with the worm wheel 44 (FIG. 4) is a gear wheel 51 of the gear-and-rack mechanism, the rack 52 of which has the pusher 3 rigidly secured thereto.

Fitted in the opening 42 (FIG. 3) of the leg 39 of the body 10 are a hollow insert 53 connected to the body 10 by means of screw nuts, and a cover 54 connected with the body 10. Therefore, the insert 53 and the cover 54 are part of the body 10.

Accommodated in the interior of the insert 53 is the sleeve 11 which extends beyond the leg 39 towards the slide 50, such as shown in FIG. 3. Accommodated in the sleeve 11 is the spring 12*a* thrusting up with its one end against the slide 50, and with another end thereof against the stop 17 arranged in the same sleeve and being in threaded engagement therewith. Thus, the connection of the spring 12*a*, i.e. of the resilient member 12, with the pusher 3 is effected through the slide 50, worm pair and gear-and-rack transmission mechanism.

Arranged in the insert 53 intermediate the projection 16 of the sleeve and the cover 54 is the spring 13*a* enabling the sleeve 11 to be retained in a position such as shown in FIG. 3. There is provided between the slide 50 and the sleeve 11 a gap 55 adjusted in the course of movement of the sleeve 11 and the compression of the spring 12*a*. The end of the sleeve 11, projecting beyond the insert 53, mounts a stop 56 which is made adjustable to thereby restrict the movement of the slide 50 relative to the sleeve 11. The stop 56 is formed as a nut screwed on the threaded end of the sleeve 11.

The inner side of the insert 53 is formed with an annular fillet 57 for the projection 16 of the sleeve 11 to bear up thereagainst, thereby restricting the movement of the sleeve 11 relative to the body 10.

The cover 54 is connected with the body 10 by means of bolts 58 also used to adjust the position of the cover 54 relative to the body 10, thereby enabling regulation of preloading force of the spring 13*a*.

The feeding device according to the invention operates in the following manner.

Through the intermediary of the rack 25 engaged with the continuously rotating gear wheel 26, or through the intermediary of the continuously rotating screw 28 (FIG. 2), the pusher 3 (FIG. 1) is brought to the tube 1 being rolled (FIGS. 1 and 2) until its butt end bears up against the projection 7 of the cylinder 6. As the tube 1 is rolled in the rolling mill, the rack 25 (FIG. 1) or the screw 28 (FIG. 2) are continuously displaced together with the body 10 along the axis of rolling in the feeding direction indicated in FIGS. 1 and 2 by arrows A. At the moment when the tube is worked by the rollers of a mill stand, the forward motion of the body 10 is transmitted through the spring 13*a* (FIGS. 1 and 2), preloaded to a force $P_2$, (FIG. 5) to the sleeve 11. During its movement, the sleeve 11 acts with its projection 14 (FIG. 1) or the flange 15 (FIG. 2) upon the spring 12*a*, the maximum compression force $P_1$, of which is lower than the compression force $P_2$ of the spring 13*a*.

Figure 5:
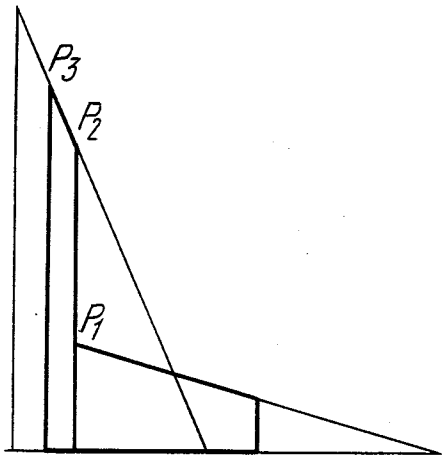
FIG. 5 is a diagram of loading of resilient members in the course of rolling.

When the butt end of the sleeve 11 (FIG. 1) reaches the projection 23 of the sleeve 8 of the pusher 3 or the flange 32 (FIG. 2), the sleeve 11 (FIG. 1 and 2) is displaced relative to the body 10, thus causing the spring 13*a* to compress. This displacement continues until a gap is formed between the rolls. The force of the spring 13*a*, acting on the butt end of the tube to be rolled, is increased to reach compression force $P_3$ (FIG. 5).

When the roll bite is formed under the action of the compression force $P_3$ of the spring 13*a* (FIG. 1 and 2), the tube 1 is twisted off the mandrel 2 to be fed by the spring 12*a* to the rolling zone for a distance determined by the adjustable stops 18 and 21 (FIG. 1) or by the stops 35 and 37 (FIG. 2), or by the speed of rotation of the screw 28 or the rack 25 (FIG. 1) during the feeding cycle.

The feeding device shown in FIG. 3 operates as follows.

At the moment when the tube being rolled is found between the rollers of a mill stand (not shown), the rack 52, gear wheel 51 and worm wheel 44 remain stationary. At this time, the continuously operating electric motor 45 causes rotation of the worm 43 whereupon it starts moving in the axial direction, thereby causing successive compression of the springs 12*a* and 13*a* through the intermediary of the slide 50. This displacement continues until the tube being rolled is released from the roll bite. At the moment when the tube 1 is released from the roll bite, the springs 12*a* and 13*a* cause the screw 43 to be moved in the opposite direction. As a result, the worm wheel 44 is actuated to thereby cause rotation of the gear wheel 51 (FIG. 4) and forward motion of the rack 52 in the feeding direction for a distance determined by the position of the adjustable stop 56 and the cover 54, as well as by the speed of rotation of the worm 43.

When the rolling cycle is resumed, the feeding device operates in the manner similar to that described above.

What is claimed is:

1. A feeding device of a tube cold-rolling mill comprising: a tube pushing means mounted coaxially with the rolling axis of a rolling mill and movable therealong; a driven continuously moving link arrangement mechanically connected with said pusher means to thereby enable its movement along the rolling axis; a transmission means for transforming continuous motion of the driven movable link arrangement into intermittent motion of the tube pushing means and adapted to effect mechanical linkage of the link arrangement with said pusher means; a body of said transmission means; a sleeve of said transmission means, slidable in the travelling direction of said pusher with the aid of said driven link arrangement; two resilient members of said transmission means, arranged coaxially with said sleeve and having different degrees of rigidity, with at least one of said resilient members being preloaded; said resilient members each having its one end connected to said sleeve to thereby enable successive compression of said resilient members caused by the movement of the sleeve, the opposite ends of each of said resilient members being respectively connected to said pusher means and body.

2. A feeding device as claimed in claim 1, wherein the resilient member connected to said sleeve and to said body has a higher degree of rigidity than the other resilient member connected to said sleeve and pusher means; the resilient member with a higher degree of rigidity being preloaded to a force exceeding a maximum compression force of the resilient member having a lower degree of rigidity.

3. A feeding device as claimed in claim 2, wherein said body is secured on the driven continuously moving link arrangement and is connected with said sleeve by means of said preloaded resilient member, whereby the sleeve displacement is enabled through the intermediary of the link arrangement.

4. A feeding device as claimed in claim 3, wherein said body is formed with an opening; said sleeve being received in the opening of said body; a stop adjustably mounted on said sleeve to thereby restrict the movement of said sleeve relative to said body and regulate a preloaded force of said resilient member; a means for adjusting positions of said stop; a shank of said pusher means, accommodated in the sleeve so that its free end extends beyond said sleeve; a stop adjustably mounted on the free end of said shank to thereby restrict the movement of said sleeve relative to said pusher means; a means for adjusting positions of said stop of said shank.

5. A feeding device as claimed in claim 3, wherein said sleeve, body and pusher means are provided with flanges; tie rods adapted to connect in pairs said flanges of said body and sleeve, and the flanges of said sleeve and pusher means; stops adjustably mounted on said tie rods to thereby restrict the movement of said tie rod relative to said pusher means; a means adapted to adjust positions of said stops.

6. A feeding device as claimed in claim 2, wherein said body is mounted stationary; said driven continuously moving link arrangement being formed as a worm of a worm pair, mounted in said body for reciprocation; a means adapted to enable reciprocation of the worm of said worm pair; an electric motor connected with the worm of the worm pair; a slide mounted within said stationary body, connected with the worm of the worm pair and adapted to enable displacement of said sleeve through the intermediary of the worm, with said resilient member having a lower degree of rigidity thrusting up against said slide and connected with said pusher means and sleeve; said sleeve being arranged within said stationary body coaxially with the worm of the worm pair and in space relationship with said slide; a stop adjustably mounted on said sleeve to restrict the movement of said slide relative to said sleeve; a gear-and-rack transmission geared to the worm pair and having the pusher secured on the rack of said gear and rack transmission mechanism, whereby the resilient member with a lower degree of rigidity is connected to the pusher means through the intermediary of said slide, worm pair and gear-and-rack transmission mechanism; a means adapted to enable adjustable displacement of said stop.

* * * * *